US010863771B2

(12) United States Patent
Borkovec et al.

(10) Patent No.: US 10,863,771 B2
(45) Date of Patent: Dec. 15, 2020

(54) ELECTRONIC SMOKING DEVICE AND ADDITIVE RESERVOIR FOR ELECTRONIC SMOKING DEVICE

(71) Applicant: Fontem Holdings 1 B.V., Amsterdam (NL)

(72) Inventors: Vaclav Borkovec, Hamburg (DE); Neha Daryani, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 72 days.

(21) Appl. No.: 15/756,524

(22) PCT Filed: Aug. 19, 2016

(86) PCT No.: PCT/EP2016/069699
§ 371 (c)(1),
(2) Date: Feb. 28, 2018

(87) PCT Pub. No.: WO2017/036819
PCT Pub. Date: Mar. 9, 2017

(65) Prior Publication Data

US 2018/0242640 A1 Aug. 30, 2018

(30) Foreign Application Priority Data

Aug. 28, 2015 (EP) ..... 15182987

(51) Int. Cl.
*A24F 47/00* (2020.01)
*A24F 40/40* (2020.01)

(52) U.S. Cl.
CPC ..... *A24F 47/008* (2013.01); *A24F 40/40* (2020.01)

(58) Field of Classification Search
CPC ..... A24F 47/008
USPC ..... 131/329
See application file for complete search history.

(56) References Cited

U.S. PATENT DOCUMENTS

2005/0016550 A1 1/2005 Makoto
2011/0011396 A1 1/2011 Fang
2013/0192615 A1 8/2013 Tucker et al.
2014/0261495 A1* 9/2014 Novak, III ..... H05B 3/46 131/329
2014/0366898 A1* 12/2014 Monsees ..... A24F 47/008 131/329
2015/0020822 A1 1/2015 Janardhan et al.
(Continued)

FOREIGN PATENT DOCUMENTS

CN 1575673 A 2/2005
CN 201085044 Y 7/2008
(Continued)

*Primary Examiner* — Eric Yaary
(74) *Attorney, Agent, or Firm* — Dykema Gossett PLLC

(57) ABSTRACT

The invention relates to electronic smoking devices (10) with an atomizer/liquid reservoir portion (14). In order to provide that additives can be used without bringing the additives in contact with an atomizer (26) of the atomizer/liquid reservoir portion (14), the invention provides an additive reservoir (40) for the electronic smoking device (10), which comprises an additive storage volume (42), a through hole (44) and an additive outlet opening (46) that opens the additive storage volume (42) to the through hole (44). Furthermore, the invention provides that the atomizer/liquid reservoir portion (14) comprises a receiving section (36) for the additive reservoir (40).

14 Claims, 3 Drawing Sheets

(56) References Cited

U.S. PATENT DOCUMENTS

| | | | | |
|---|---|---|---|---|
| 2015/0027454 | A1 | 1/2015 | Li et al. | |
| 2016/0128384 | A1* | 5/2016 | Luciani | A24F 47/008 131/329 |

FOREIGN PATENT DOCUMENTS

| | | | |
|---|---|---|---|
| CN | 102655773 | A | 9/2012 |
| CN | 104284606 | A | 1/2015 |
| WO | 2015038981 | A2 | 3/2015 |

* cited by examiner

ELECTRONIC SMOKING DEVICE AND ADDITIVE RESERVOIR FOR ELECTRONIC SMOKING DEVICE

FIELD OF INVENTION

The present invention relates generally to electronic smoking devices, in particular electronic cigarettes, and to additive reservoirs for electronic smoking devices.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic smoking devices, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other electronic smoking devices, a switch is used to power up the electronic smoking devices to generate a puff of vapor.

It is known to provide base liquids to be atomized or vaporized with electronic smoking devices with an additive, e.g. a flavor material.

SUMMARY OF THE INVENTION

In accordance with one aspect of the present invention, there is provided an electronic smoking device comprising: an air inhalation port, an atomizer/liquid reservoir portion, an air duct and an additive reservoir. The atomizer/liquid reservoir portion comprises a liquid reservoir and an atomizer. The atomizer is adapted to atomize a liquid stored in the liquid reservoir. The air duct is configured to guide atomized liquid from the atomizer towards the air inhalation port. The electronic smoking device comprises an additive reservoir provided between the atomizer and the air inhalation port. The additive reservoir comprises an additive storage volume and a through hole. The through hole extends through the additive reservoir and being configured to communicate with the air duct to guide atomized liquid to the air inhalation port. An additive outlet opening of the additive reservoir opens the additive storage volume to the through hole. For example, the liquid reservoir is connected to the atomizer in a liquid supplying manner, and the air duct is connected to the atomizer in an aerosol discharging manner. In accordance with another aspect of the present invention, there is provided an additive reservoir for an electronic smoking device, e.g. for the electronic smoking device according to the one aspect. The additive reservoir comprises an additive storage volume, a through hole that extends through the additive reservoir, and an additive outlet opening that opens the additive storage volume to the through hole. The additive reservoir of the other aspect may be the additive reservoir of the one aspect.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
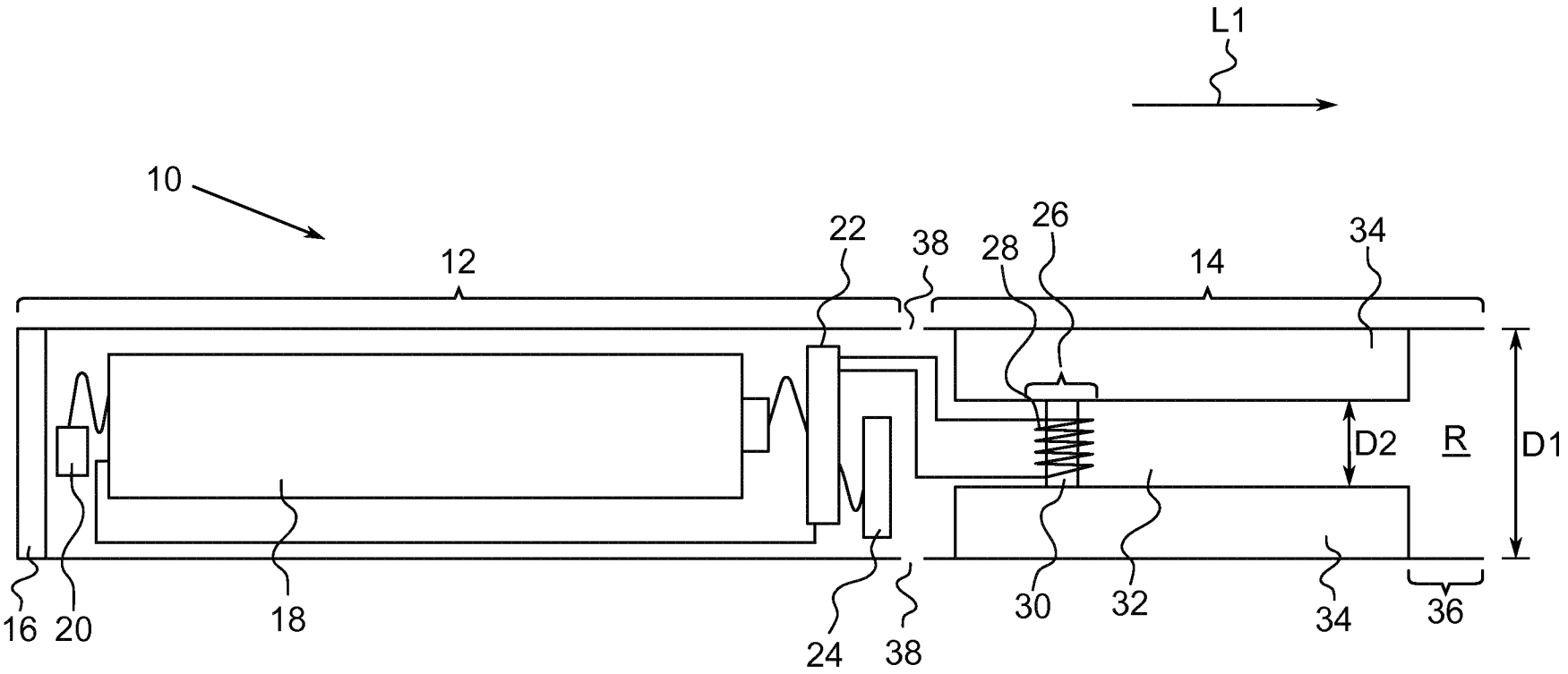
FIG. 1 is a schematic cross-sectional illustration of an exemplary electronic smoking device.

Throughout the following, an electronic smoking device, for example an e-cigarette, will be described exemplarily. As is shown in FIG. 1, an electronic smoking device 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Alternatively, the cylindrical hollow tube is formed as a single piece with the battery portion 12 and the atomizer/liquid reservoir portion 14. Together the battery portion 12 and the atomizer/liquid reservoir portion 14 form the cylindrical tube which can be approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of metal, e.g. steel or aluminum, or of hardwearing plastic and act together with the end cap 16 to provide a housing to contain the components of the electronic smoking device 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow an LED 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, a light-emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across an air duct 32 shown as a central passage of the atomizer/liquid reservoir portion 14. The coil 28 may be positioned anywhere in the atomizer 26 and may be transverse or parallel to the liquid reservoir 34. The wick 30 and heating coil 28 do not completely block the central passage. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage with the ends of the wick 30 abutting the wadding. In other embodiments the liquid reservoir 34 may comprise a toroidal cavity arranged to be filled with liquid and with the ends of the wick 30 extending into the toroidal cavity.

A receiving section 36 for an additive reservoir is provided at the back end of the atomizer/liquid reservoir portion 14 remote from or opposite of the end cap 16. The receiving section 36 may be formed by the cylindrical hollow tube at the atomizer/liquid reservoir portion 14 or may be formed by an end cap. An air duct 32, e.g. the central passage, extends from the atomizer 26 to the receiving section 36, into which the air duct 32 opens.

In use, a user sucks on the electronic smoking device 10. This causes air to be drawn into the electronic smoking device 10 via one or more air inlets, such as air inlets 38, and to be drawn through the central passage towards the receiving section 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage. As the user continues to suck on the electronic smoking device 10, this aerosol is drawn through the central passage and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34, after which the electronic smoking device 10 is thrown away. In other embodiments the battery 18 is replaceable or rechargeable and the liquid reservoir 34 is replaceable or refillable. In the cases where the liquid reservoir 34 is a toroidal cavity, this may be achieved by refilling the liquid reservoir 34 via a refill port. In other embodiments, the atomizer/liquid reservoir portion 14 of the electronic smoking device 10 is detachable from the battery portion 12 and another atomizer/liquid reservoir portion 14 with a new liquid reservoir 34 can be fitted, thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer or clearomizer.

The liquid reservoir 34 may be in the form of a cartridge having a central passage through which a user inhales aerosol. In other embodiments, aerosol may flow around the exterior of the cartridge to the receiving section 36.

Of course, in addition to the above description of the structure and function of a typical electronic smoking device 10, variations also exist. For example, the LED 20 may be omitted. The airflow sensor 24 may be placed adjacent the end cap 16 rather than in the middle of the electronic smoking device. The airflow sensor 24 may be replaced with a switch which enables a user to activate the electronic smoking device manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

The liquid reservoir 34 abuts on a receiving volume R of the receiving section 36, in which the additive reservoir is arranged in its mounted state. The liquid reservoir 34 is arranged between the receiving volume R and the end cap 16. In particular, in a longitudinal direction L1 of the atomizer/liquid reservoir portion 14, the receiving volume R is arranged behind the liquid reservoir 34. The longitudinal direction L1 extends from the atomizer 26 towards the back end of the atomizer/liquid reservoir 14, the receiving section 36 and its receiving volume R being arranged at the back end. An inner diameter D1 of the receiving section 36 at the receiving volume R is greater than an inner diameter D2 of the air duct 32 and e.g. of the central passage. The receiving volume R opens away from the atomizer 26 and/or from the liquid reservoir 34, i.e. in the longitudinal direction L. The hollow tube that forms the atomizer/liquid reservoir portion 14 also forms the receiving section 36, such that the inner diameter D1 of the receiving section 36 corresponds to an inner diameter of the hollow tube at other parts of the atomizer/liquid reservoir portion 14. Hence, the atomizer/liquid reservoir portion 14 may have a constant inner diameter.

Figure 2:
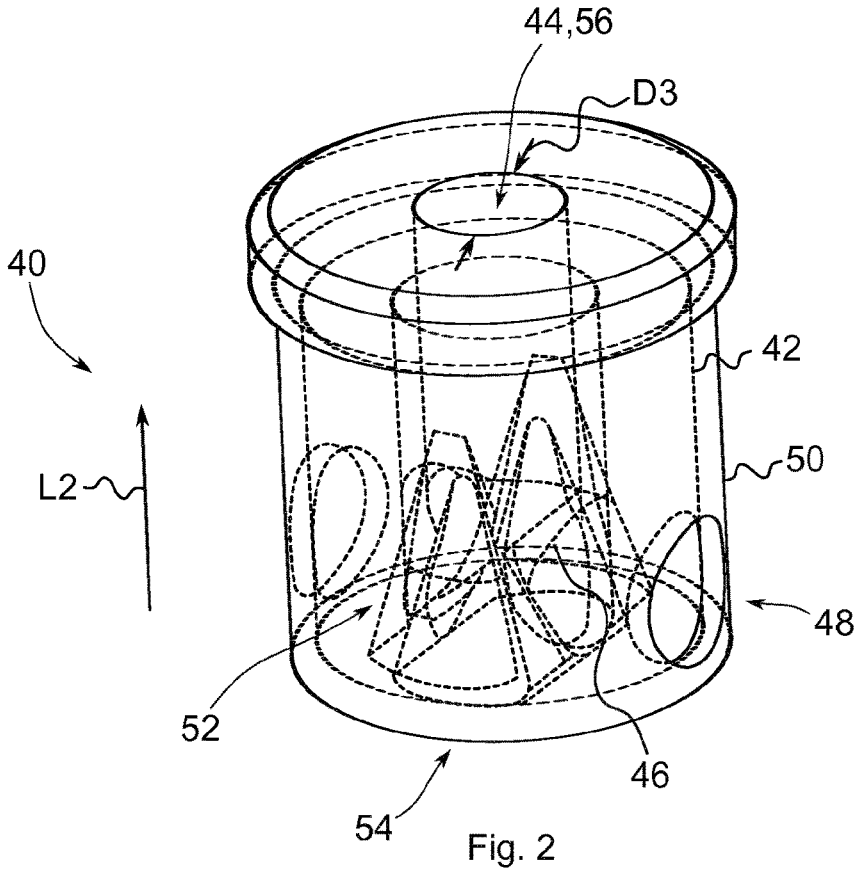
FIG. 2 is a schematic perspective view of an exemplary embodiment of an additive reservoir.

FIG. 2 shows an exemplary embodiment of an additive reservoir 40 for the electronic smoking device 10 of the exemplary embodiment of FIG. 1. The additive reservoir 40 comprises an additive storage volume 42 for storing an additive that is to be added to vaporized liquid atomized or vaporized by the atomizer 26 of the electronic smoking device 10 prior to inhalation of the resulting aerosol by a user of the electronic smoking device 10. The additive comprises flavor and/or nicotine.

Furthermore, the additive reservoir 40 is shown with a through hole 44. The through hole 44 extends along a longitudinal direction L2, wherein the longitudinal direction L2 corresponds to the longitudinal direction L1 of the electronic smoking device 10 in case the additive reservoir 40 is inserted into the receiving volume R.

An additive outlet opening 46 of the additive reservoir 40 opens the additive storage volume 42 to the through hole 44, such that additive can exit the additive storage volume 42 into the through hole 44 and mix with atomized liquid to be inhaled by the user in the through hole 44.

The additive reservoir 40 is shown with an additive supply duct 48 that extends from an outer lateral side 50 of the additive reservoir 40 through the additive outlet opening 46 into the through hole 44. Hence, an advantage of such an additive reservoir 40 may be that the additive outlet opening 46 can be easily formed, e.g. by injection molding, together with the additive supply duct 48.

The additive storage volume 42 extends around the through hole 44 and forms a cylindrical additive storage volume.

As an alternative to a liquid additive that is freely arranged in the additive storage volume 42, the additive reservoir 40 may comprise wadding soaked in additive, which encircles the through hole 44 with an end of the wick 30 abutting the wadding. In other embodiments, the additive storage volume 42 may comprise a toroidal cavity arranged to be filled with liquid additive and with the end of the wick 30 extending into the toroidal cavity.

In order to be able to transport more additive into the through hole 44, the additive supply duct 48 completely extends through the additive reservoir 40. In case the through hole 44 extends through the additive storage volume 42, such that the additive storage volume 42 encircles the through hole 44 completely perpendicular to the longitudinal direction L2, additive can enter the through hole 44 from different and e.g. opposite directions via the additive supply duct 48. In particular, the additive supply duct 48 extends through different and for example opposite sections of the additive storage volume 42, such that the additive supply duct 48 is formed e.g. as a straight duct 48. An advantage of such a straight additive supply duct may be that the additive supply duct 48 can be formed easily, e.g. by drilling or injection molding.

The through hole 44 may have a constant inner diameter D3 along the longitudinal direction L2. However, in FIG. 2, the through hole 44 comprises a constricting section 52, in which the inner diameter D3 decreases along the longitudinal direction L2. The additive outlet opening 46 opens into the through hole 44 in its constricting section 52. Along the longitudinal direction L2, the through hole 44 reaches its maximum inner diameter D3 at its first longitudinal end 54. Opposite of the first longitudinal end 54, the through hole 44 comprises a second longitudinal end 56. Between the constricting section 52 and the second longitudinal end 56, the through hole 44 at least section-wise has an inner diameter D3 that is smaller than the maximum inner diameter D3 at the first longitudinal end 54. For example, the inner diameter D3 of the through hole 44 between the constricting section 52 and the second longitudinal end 56 is smaller than the inner diameter D2 in the constricting section 52. The inner diameter D2 is for example constant between the constricting section 52 and the second longitudinal end 56.

An advantage of the constricting section 52 and the additive outlet opening 46 may be that the through hole 44 connects the air duct 32, e.g. the central passage, to the air inhalation port 72 of the electronic smoking device 10 in an aerosol-conducting manner and with a smooth or gradual transition into the constricting section 52, which reduces turbulent flow and undesired condensation of the atomized liquid.

The inner diameter D2 of the air duct 32, e.g. the central passage, essentially corresponds to the maximum inner diameter D3 of the through hole 44, at the first longitudinal end 54. Thus, a transition from the air duct 32 into the through hole 44 can be smooth without steps, which would cause turbulences and condensation of atomized liquid.

Figure 3:
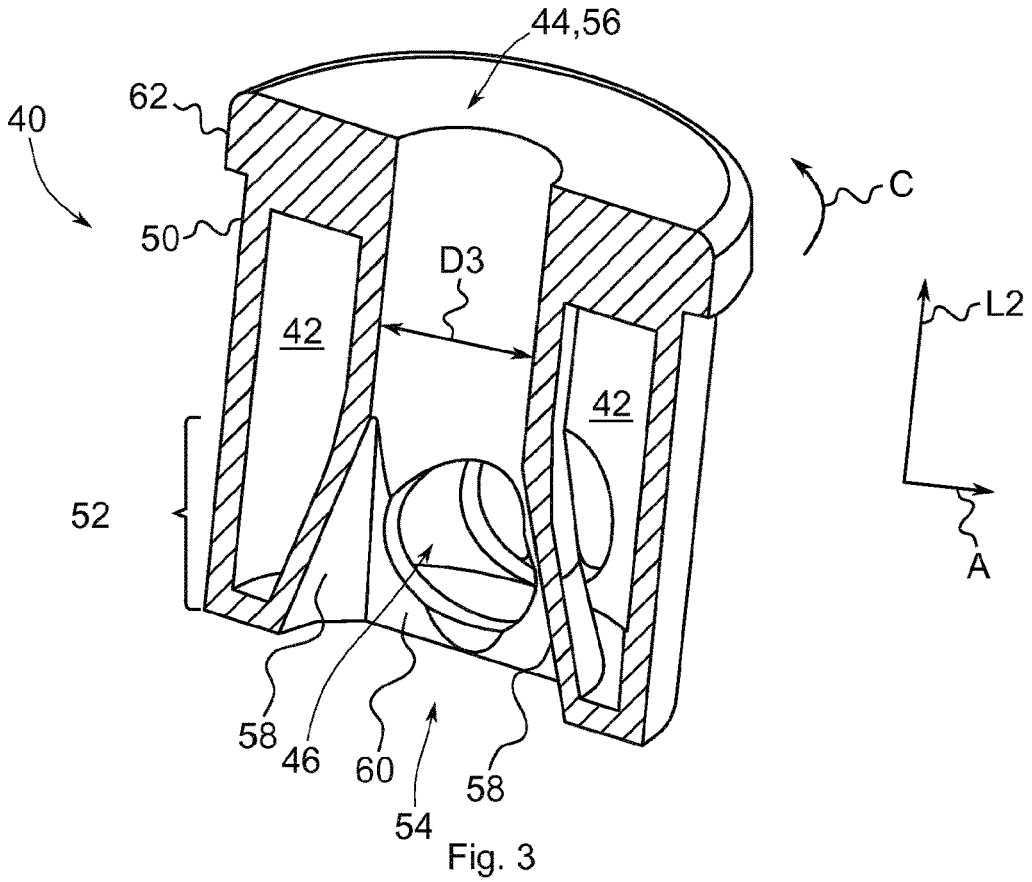
FIG. 3 is a schematic cross-sectional view of the additive reservoir according to the exemplary embodiment of FIG. 2.

FIG. 3 shows the exemplary embodiment of FIG. 2 schematically in a cross-sectional view, with the cross-section extending along the longitudinal direction L2 through the through hole 44.

In the constricting section 52, the through hole 44 is formed by a first and a second pair of opposite lateral side sections 58, 60. The opposite lateral side sections 58 of the first pair are tapered towards each other, such that the inner diameter D3 of the through hole 44 decreases along the longitudinal direction L2 from the first longitudinal end 54 of the through hole 44 towards the second longitudinal end 56 of the through hole 44 in the constricting section 52.

The opposite lateral side sections 60 of the second pair, of which only one lateral side section 60 is shown and the other one is omitted due to the cross-sectional view of FIG. 3, are tapered less towards each other than the lateral side sections 58 of the first pair. Hence, the distance between the opposite lateral side sections 60 of the second pair decreases less than the distance between the opposite lateral side sections 58 of the first pair in the course of the lateral side sections 58, 60 along the longitudinal direction L2. Thus, from the second longitudinal end 56 towards the first longitudinal end 54, the diameter D3 increases more between the opposite lateral side sections 58 of the first pair than the distance between the opposite lateral side sections 60 of the second pair.

For example, the distance between the opposite lateral side sections 60 of the second pair may be constant, such that the opposite lateral side sections 60 extend parallel to each other and e.g. to the longitudinal direction L2. The additive outlet opening 46 is arranged in one of the opposite lateral side sections 60 of the second pair. An advantage of the differently tapering pairs of opposite lateral side sections 58, 60 may be that the size of the additive storage volume 42 can be maximized without unduly affecting the transition from the central passage to the through hole.

The additive reservoir 40 is formed essentially cylindrical and in particular as a right circular cylinder with the through hole 44 extending along a central axis of the cylinder. The additive reservoir 40 comprises a protrusion 62 that projects from the outer lateral side 50 of the additive reservoir 40. The protrusion 62 is provided as a stop for delimiting the insertion depths of the additive reservoir 40 into the receiving section 36. For example, the protrusion 62 at least section-wise or even completely extends around the through hole 44 in a circumferential direction C of the additive reservoir 40 that extends perpendicular to the longitudinal direction L2. Thus, the protrusion 62 forms a protruding ring that protrudes from the outer lateral side 50 in a radial direction A of the additive reservoir 40, the radial direction A extending perpendicularly to the longitudinal direction L2 and/or the circumferential direction C.

Figure 4:
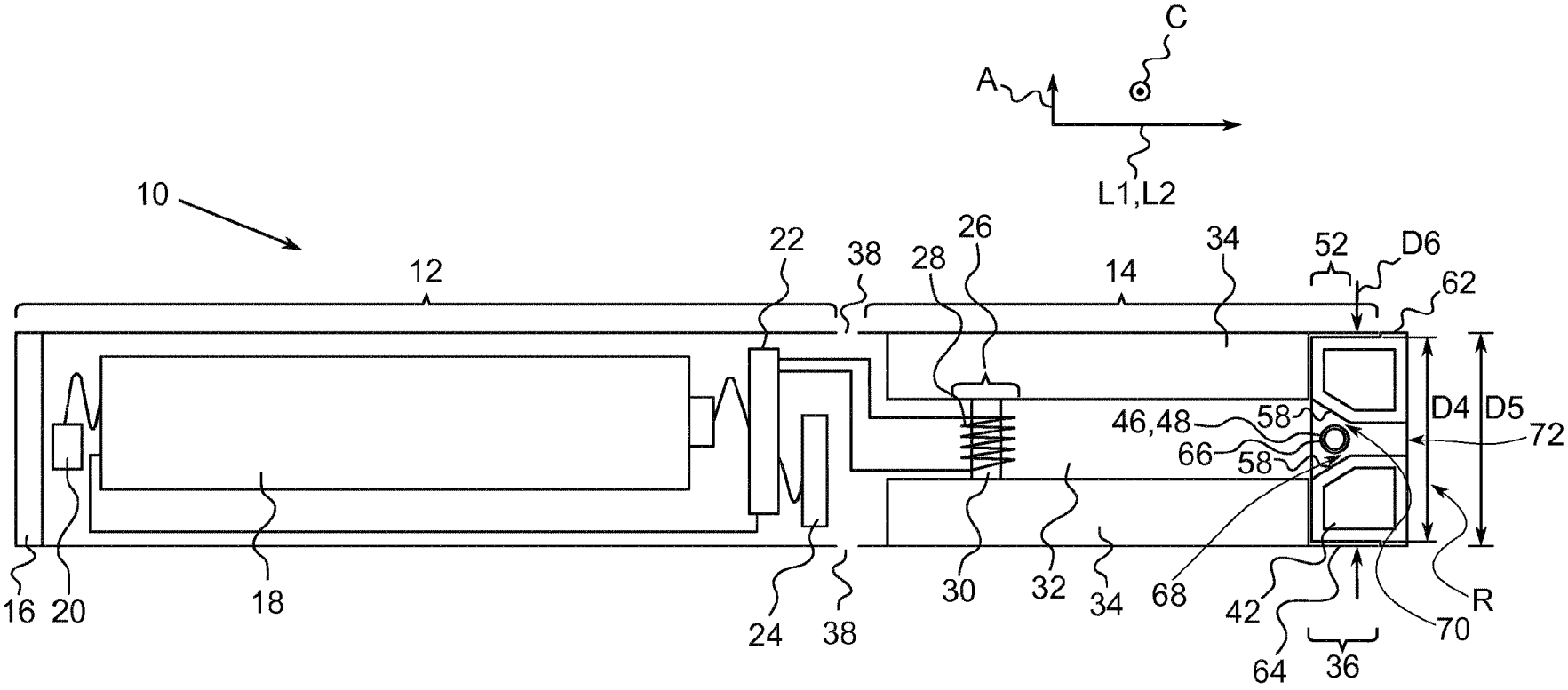
FIG. 4 is a schematic cross-sectional view of the electronic smoking device of FIG. 1 with the additive reservoir of FIGS. 2 and 3.

FIG. 4 shows the electronic smoking device 10 of the exemplary embodiment of FIG. 1 with the additive reservoir 40 of the exemplary embodiment of FIGS. 2 and 3 inserted into the receiving volume R of the receiving section 36.

The additive reservoir 40 is shown inserted into the receiving volume R against the longitudinal direction L1. In the inserted state shown in FIG. 4, the longitudinal directions L1, L2 correspond to each other. The air duct 32 is connected to the through hole 44, in particular in a gas and/or aerosol conductive manner. For example, the through hole 44 directly or indirectly follows the air duct 32 in the longitudinal direction L1 and the air duct 32 may open into the through hole 44. The additive outlet opening 46 is arranged at a distance to the atomizer 26 along the longitudinal direction L1 and for example between the air inhalation port 72 and the atomizer 26.

In order to avoid that atomized liquid can exit the electronic smoking device 10 at any other location other than the receiving section 36 at the back end of the electronic smoking device 10, the additive reservoir 40 is formed such that it can be inserted into the receiving volume R at zero clearance. Thus, the outer lateral side 50 extensively abuts against the hollow tube and forms a sealing area between the hollow tube and the outer lateral side 50 that extends completely around the through hole 44 in the circumferential direction C. Hence, an outer diameter D4 of the additive reservoir 40 is essentially equal to or less than the inner diameter D1 of the hollow tube at least at the receiving section 36. Alternatively or additionally, a front face of the additive reservoir 40 that faces against the longitudinal direction L1, L2 abuts against the liquid reservoir 34 and forms the sealing area to avoid that atomized liquid can pass between the additive reservoir 40 and the liquid reservoir 34. In the alternative, a sealing element, for example a sealing ring that extends in the circumferential direction C, is arranged between the additive reservoir 40 and the hollow tube or between the additive reservoir 40 and the liquid reservoir 34.

The protrusion 64 comprises an outer diameter D5 that is greater than the inner diameter D1 of the hollow tube at the receiving section 36. For example, the outer diameter D5 of the additive reservoir 40 at its protrusion 62 corresponds to an outer diameter D6 of the receiving section 36, such that an outer lateral side of the receiving section 36 is flush with the protrusion 62. An advantage of such an embodiment may be that the protrusion 62 forms a handling element for grasping and removing the additive reservoir 40 from the receiving section 36 in addition or alternatively to the stop. The handling element provided by the protrusion 62 is arranged outside of the receiving volume R and protrudes from the receiving section 36.

The receiving section 36 may have a closed side wall 64 that extends along the longitudinal direction L1 and that closes the additive supply duct in order to avoid that additive exits the additive storage volume 42 away from the through hole 44.

At least one wick 66 and for example two wicks can extend from the additive storage volume 42 into the through hole 44 from the different directions. In particular, the wick 66 extends through the additive outlet opening 46 into the through hole 44 perpendicular to the plane of projection in FIG. 4. The wick 66 may completely extend through the additive reservoir 40, in case the additive supply duct 48 is provided and completely extends through the additive reservoir 40 or at least from one side of the additive storage volume 42 to another and in particular to the opposite side of the additive storage volume 42.

In case the additive supply duct 48 is formed straight and extends at least sectionwise or completely through the additive supply 40, another advantage may be that the wick 66 can be easily inserted into the straight additive supply duct 48. Depending on the evaporation number or evaporation rate of the additive, the additive reservoir 40 may be formed with an atomizer-free wick. An advantage of atomizer-free wick may be that the additive is not atomized, e.g. by heat. Heating up the additive, namely, may result in an undesired change of the additive and for example of flavor, which may result in a different flavor taste.

Additive that can be provided to the atomized liquid with using an atomizer may comprise compounds with a volatility higher than water and for example higher than the liquid to be atomized. For example, the compounds of the additive may have an evaporation number less than 10, less than 8, less than 5, less than 2.5, and for example of 8.3. Alternatively, the compounds of the additive may have an evaporation rate greater than 3, greater than 5 or greater than 8, for example an evaporation rate of 3.8.

Furthermore, the additive may comprise a flavored material and/or nicotine, wherein the flavored material and/or the nicotine vaporizes at room temperature and under ambient pressure by evaporation without heating or other action of an atomizer.

The flavored materials are for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavored materials as mentioned above into new flavored materials. Moreover, it is possible to adsorb any flavor onto a solid material and to use this material as flavored material within an electronic smoking device according to the present invention.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or of the aroma compound of the compounds of the additive may have evaporation numbers between 3.8 and 10. In general, aroma compounds are highly volatile and this is the reason why we can smell them at room temperature. In case the flavor and/or the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The wick 66 abuts on or extends into the additive storage volume 42 and may be a porous material such as a bundle of fiber glass fibers with additive in the additive storage volume 42 being drawn by capillary action from the end of the wick 66 towards the through hole 44.

In case the wick 66 extends from the through hole in opposite directions into the different sections of the additive supply duct 48 of additive storage volume 42, additive is transported towards a center of the through hole 44. An advantage of such an additive reservoir 40 may be that more additive is brought into the through hole 44 and can be added to the atomized liquid, wherein the additive can mix with the atomized liquid evenly distributed.

In case the wick 66 is used for transporting additive into the through hole 44, atomized liquid can pass the wick 66 within the constricting section 52, which has a greater inner diameter D2 than other sections of the through hole 44.

An advantage of such an arrangement of the additive outlet opening 46 may be that between the opposite lateral side sections 58 of the first pair, and the wick 66 that extends through the additive outlet opening 46 into the through hole 44, a free space remains for conducting atomized liquid along the wick 66 in the longitudinal direction L2 towards the second longitudinal end 56 of the through hole 44. In particular, in a radial direction A of the additive reservoir 40, perpendicular to which the through hole 44 extends, flow-through volumes 68, 70 remain between the wick 66 and the opposite lateral side sections 58 of the first pair. The wick 66 is arranged between the flow-through volumes 68, 70, such that atomized liquid or an aerosol comprising the atomized liquid can take in additive from opposite sides of the wick 66 effectively.

At the second longitudinal end 56, the through hole 44 provides an air inhalation port 72 at the back end of the atomizer/liquid reservoir portion 14 remote from the end cap 16, in case the additive reservoir 40 is inserted into the receiving volume R. Via the air inhalation port 72, a user of the electronic smoking device 10 inhales an aerosol comprising atomized liquid atomized by the atomizer 26 and enriched with additive from the additive reservoir 40.

In summary, in one aspect, an electronic smoking device is provided. The electronic smoking device comprises an air inhalation port, an atomizer/liquid reservoir portion, an air duct and an additive reservoir. The atomizer/liquid reservoir portion comprises a liquid reservoir and an atomizer. The atomizer is adapted to atomize a liquid stored in the liquid reservoir. The air duct is configured to guide atomized liquid from the atomizer towards the air inhalation port. The electronic smoking device comprises an additive reservoir provided between the atomizer and the air inhalation port. The additive reservoir comprises an additive storage volume and a through hole. The through hole extends through the additive reservoir and being configured to communicate with the air duct to guide atomized liquid to the air inhalation port. An additive outlet opening of the additive reservoir opens the additive storage volume to the through hole. For example, the liquid reservoir is connected to the atomizer in a liquid supplying manner, and the air duct is connected to the atomizer in an aerosol discharging manner. In accordance with another aspect, there is provided an additive reservoir for an electronic smoking device, e.g. for the electronic smoking device according to the one aspect. The additive reservoir comprises an additive storage volume, a through hole that extends through the additive reservoir, and an additive outlet opening that opens the additive storage volume to the through hole. The additive reservoir of the other aspect may be the additive reservoir of the one aspect.

The electronic smoking device comprises an atomizer/liquid reservoir portion, wherein the atomizer/liquid reservoir portion comprises a liquid reservoir, an atomizer and an air duct, the liquid reservoir and the air duct being connected to the atomizer, and wherein the atomizer/liquid reservoir portion comprises an additive storage volume. The additive storage volume comprises an additive storage volume, a through hole that extends through the additive reservoir, and an additive outlet opening that opens the additive storage volume to the through hole (44). The additive outlet opening is arranged at a distance to the atomizer. In the other aspect, an additive reservoir for an electronic smoking device is provided. The additive reservoir comprises an additive storage volume, a through hole that extends through the additive reservoir, and an additive outlet opening that opens the additive storage volume to the through hole.

An advantage of the above aspects may be that, due to the distance between the atomizer and the additive outlet opening, an additive and, for example, a flavor, can be added to the vapor provided to the user without atomizing the additive with the atomizer.

The additive reservoir may be provided between the air inhalation port and the liquid reservoir. The additive outlet opening may be arranged at a distance to the atomizer. The liquid reservoir and the additive reservoir may be provided adjacent to each other. Thus, an advantage of these embodiments may be that the assembly of the electronic smoking device can be facilitated.

The atomizer/liquid reservoir portion may comprise a receiving section for receiving the additive reservoir. In particular, the additive reservoir may be received or arranged in the receiving section may be affixed within or removable from the receiving section. With or without the receiving section, the additive reservoir may be fixedly installed within the electronic smoking device. In particular, the storage volume of the additive reservoir differs from and may be separated from a storage volume of the liquid reservoir. However, in case the receiving section is provided, the additive reservoir may repeatedly inserted into and removed from the receiving section, such that the additive and, for example, a flavor, can be added to the electronic smoking device and/or exchanged at the user's choice in order to be consumed by a user of the electronic smoking device. Hence, the additive reservoir can be designated as additive reservoir insert.

The atomizer/liquid reservoir portion for the electronic smoking device and additive storage volume for the electronic smoking device may be provided together with each other and/or with other components of the electronic smoking device or separate from each other and/or from other components of the electronic smoking device. The atomizer/liquid reservoir portion comprises the liquid reservoir, the atomizer and the air duct, wherein the liquid reservoir is connected to the atomizer, e.g. in a liquid-conducting manner, and the air duct is connected to the atomizer, for example in order to transport air and atomized liquid to a user of the electronic smoking device. The atomizer/liquid reservoir portion comprises the receiving section for receiving an additive reservoir according to the one aspect of the invention. In case the atomizer/liquid reservoir portion is provided separate from the other components, the atomizer/liquid reservoir portion may be provided as a replacement module for replacing an atomizer/liquid reservoir portion of the electronic smoking device.

The additive reservoir for an electronic smoking device may be provided with the electronic smoking device or with the atomizer/liquid reservoir portion, for example as a kit. Alternatively, the additive reservoir can be provided separate from the electronic smoking device or from the atomizer/liquid reservoir portion, e.g. as a replacement for an additive reservoir of the electronic smoking device. In particular, the additive reservoir can be provided alone or with at least one other additive reservoir.

Thus, the atomizer/liquid reservoir portion and the additive reservoir are each advantageous of itself.

In a mounted state of the additive reservoir, in which the additive reservoir is inserted into the receiving section, the additive reservoir may be arranged downstream of the atomizer, such that an advantage of the above aspects may be that additive ejected from the additive reservoir into an air stream from the atomizer does not contact the atomizer. Hence, additive to be inhaled together with the atomized material is not affected by the atomizer and e.g. by heat dissipated by the atomizer. Furthermore, additive from the additive reservoir does not contact and aggregate at the atomizer. Thus, another advantage of the additive reservoir and the atomizer/liquid reservoir portion may be that, with the additive reservoir being replaceable, different additives can be used without mixing at the atomizer.

The additive reservoir may comprise an additive supply duct that extends from an outer lateral side of the additive reservoir through the additive outlet opening into the through hole. Hence, in case a wick is used to transport additive from the additive storage volume into the through hole, the wick can be easily introduced.

The additive supply duct can completely extend through the additive reservoir. Such an additive supply duct can be easily formed, for example by injection molding, by providing a slider in an injection molding tool.

The additive supply duct may extend through to different sections of the storage volume. For example, the two different sections are arranged opposite of each other with respect to the through hole. An advantage of such an additive reservoir may be that additive is introduced into the through hole from two different and e.g. opposite sides, such that the additive is equally distributed and can be supplied at high volumes.

The additive storage volume may be provided by a single compartment that can be ring-shaped and that can extend around the through hole. Alternatively, the additive storage volume can comprise more than one and for example two compartments, wherein each of the compartments is connected to the through hole in additive-conductive manner, for example by at least one additive outlet opening.

The additive supply duct may be formed as a straight duct. An advantage of such an additive supply duct may be that the supply duct can be easily formed by a single sliding element in an injection molding tool.

The additive reservoir may comprise a wick that extends through the additive outlet opening into the through hole. The wick can readily transport the additive into the through hole through capillary action. An advantage of such an additive reservoir may be that the additive reservoir can have a simple design without valves or nozzles for dosing additive into the through hole.

The wick can be an atomizer-free wick such that additive can be released from the wick without atomizing or vaporizing the additive with an atomizer. Thus, an advantage of such an additive reservoir may be that the additive reservoir needs not to be connected to a power supply, e.g. of the electronic smoking device, in order to provide additive to the user via the atomized liquid.

Additive that can be provided to the atomized liquid with using an atomizer may comprise compounds with a volatility higher than water and for example higher than the liquid to be atomized. For example, the compounds of the additive may have an evaporation number less than 10, less than 8, less than 5, less than 2.5, and for example of 8.3. Alternatively, the compounds of the additive may have an evaporation rate greater than 3, greater than 5 or greater than 8, for example an evaporation rate of 3.8.

Furthermore, the additive may comprise a flavored material and/or nicotine, wherein the flavored material and/or the nicotine vaporizes at room temperature and under ambient pressure by evaporation without heating or other action of an atomizer.

The flavored materials are for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavored materials as mentioned above into new flavored materials. Moreover, it is possible to adsorb any flavor onto a solid material and to use this material as flavored material within an electronic smoking device according to the present invention.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or of the aroma compound of the compounds of the additive may have evaporation numbers between 3.8 and 10. In general, aroma compounds are highly volatile and this is the reason why we can smell them at room temperature. In case the flavor and/or the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The wick may extend from the through hole in opposite directions into different sections of the additive storage volume. Thus additive can flow in opposite directions into the through hole and towards a center of the through hole. An advantage of such an additive reservoir may be that the additive is equally distributed and released to the atomized liquid and a gas, e.g. air, that flow through the through hole towards a user of the electronic smoking device.

The through hole of the additive reservoir has a maximum inner diameter that essentially corresponds to the inner diameter of the air duct. Thus, the air duct can smoothly pass into the through hole with a small or even without any step between the air duct and the through hole. An advantage of this embodiment may be that condensation of atomized liquid is minimized or even prevented at the transition between the air duct and the through hole.

The through hole may comprise a constricting section, in which an inner diameter of the through hole decreases, in particular from the maximum inner diameter. The additive outlet opening may open into the constricting section. An advantage of the constricting section may be that an aerosol that comprises atomizer liquid can be guided into the through hole and/or to the wick with low amount of turbulences to reduce condensation of atomized liquid and/or in order to effectively receive additive from the additive outlet opening and/or the wick.

In the constricting section, the through hole may be formed by a first and a second pair of opposite lateral side sections. The first pair of opposite lateral side sections differs from the second pair of opposite lateral side sections by their arrangement. For example, the first pair of opposite lateral side sections is rotated around a central axis of the through hole by 90° with respect to the second pair of opposite lateral side sections. The opposite lateral side sections of the first pair may be tapered towards each other and the opposite lateral side sections of the second pair are tapered towards less towards each other than the lateral side sections of the first pair in the course of the lateral side sections along a longitudinal direction of the through hole. Due to the smaller tapering angle of the opposite lateral side sections, a larger storage volume for additive is available in the additive storage volume compared to an additive reservoir, in which both pairs of opposite lateral side sections have the same tapering angle.

The additive outlet opening may be arranged in one of the lateral side sections of the second pair. Due to the greater tapering angle of the opposite lateral side sections of the first pair, flow-through volumes remain between the wick and the opposite lateral side sections of the first pair, through which atomized liquid can easily flow. For example, the additive supply duct can extend through the opposite lateral side sections of the second pair.

The additive reservoir may be formed essentially cylindrical and may comprise a protrusion that projects from an outer lateral side of the additive reservoir. An advantage of the protrusion may be that the protrusion forms a stop that limits insertion depth of the additive reservoir into the receiving section.

The protrusion may at least section-wise or even completely extend around the through hole in a circumferential direction of the additive reservoir. An advantage of such a protrusion may be that the protrusion provides the stop independent of a rotational position of the additive reservoir around its central axis in the receiving section, which facilitates inserting the additive reservoir into the receiving section.

The air duct and e.g. the central passage may extend from the atomizer to the receiving section, in which it opens. An advantage of such an air duct may be that atomized liquid can readily flow towards the additive reservoir with the atomizer/liquid reservoir portion having a simple design.

A one-way valve may be provided downstream of the atomizer in the air duct, e.g. the central passage, or in the through hole, for example upstream of the additive outlet opening, such that the additive outlet opening is arranged between the valve and the protrusion or an air outlet opening for the electronic smoking device provided by the additive reservoir at an end of the through hole that faces the user of the electronic smoking device when the user takes a puff. An advantage of the one-way valve may be that flow of additive towards the atomizer is blocked, such that additive does not gather at the atomizer. The one-way valve can be actuated by the user sucking on the additive reservoir, wherein the one-way valve opens due to the reduced pressure caused by the user sucking on the additive reservoir. After the user has finished sucking on the additive reservoir, the one-way valve may automatically close, for example due to spring forces.

An inner diameter of the receiving section may be greater than an inner diameter of the air duct. For example, the receiving section may comprise a receiving volume for receiving the additive reservoir. An inner diameter of the air duct, for example the central passage, can be smaller than an inner diameter of the receiving opening. An advantage of such an atomizer/liquid reservoir portion may be that the liquid reservoir, through which the central passage extends, may form a sealing stop for the additive reservoir, such that a front face of the additive reservoir can abut against a front face of the liquid reservoir in an aerosol-tight manner. Alternatively or additionally, an outer diameter of the additive reservoir may essentially correspond to an inner diameter of the receiving section, such that the additive reservoir can be inserted into the receiving section essentially at zero clearance, thereby forming an aerosol-tight seal. Alternatively or additionally, a sealing element, for example a sealing ring, can be placed between the additive reservoir and the receiving section, or between the additive reservoir and the liquid reservoir.

The additive reservoir may be provided separate from other components of the electronic smoking device and for example with at least one other additive reservoir, wherein the additive reservoir may have the same structure. Further, the electronic smoking device may be provided without the additive reservoir In case the additive reservoir may be provided separate, the additive reservoir may comprise the additive supply duct that extends from the outer lateral side of the additive reservoir through the additive outlet opening into the through hole. The below features may have the same technical effect and advantage as the corresponding features of the electronic smoking device.

The additive supply duct may be formed as a straight duct and completely extend through the additive reservoir.

The additive reservoir may comprise the wick that extends through the additive outlet opening into the through hole. The wick may extend from the through hole in opposite directions into different sections of the additive storage volume.

The through hole may comprise a constricting section in which a diameter of the through hole decreases, wherein the additive outlet opening opens into the constricting section.

In the constricting section, the through hole may be formed by the first and a second pair of opposite lateral side sections, wherein the opposite lateral side sections of the first pair are tapered towards each other and the opposite lateral side sections of the second pair are tapered less towards each other than the opposite lateral side sections of the first pair. The additive outlet opening may be arranged in one of the lateral side sections of the second pair.

The additive reservoir may be formed essentially cylindrical and may comprise a protrusion that projects from an outer lateral side of the additive reservoir.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 battery portion
14 atomizer/liquid reservoir portion
16 end cap
18 battery
20 light-emitting diode (LED)
22 control electronics
24 airflow sensor
26 atomizer
28 heating coil
30 wick of 14
32 air duct
34 liquid reservoir
36 receiving section
38 air inlets
40 additive reservoir
42 additive storage volume
44 through hole
46 additive outlet opening
48 additive supply duct
50 outer lateral side of 40
52 constricting section of 44
54 first longitudinal end of 44
56 second longitudinal end of 44
58 lateral side sections of first pair
60 lateral side sections of second pair
62 protrusion
64 closed side wall
66 wick of 40
68, 70 flow-through volume
72 air inhalation port
A radial direction
C circumferential direction of 40
D1, D2, D3 inner diameter of 36, 32, 44
D4, D5, D6 outer diameter of 40, 64, 36
L1, L2 longitudinal direction of 14, 44
R receiving volume

The invention claimed is:

1. An electronic smoking device comprising:
an air inhalation port;
an atomizer/liquid reservoir portion comprising:
a liquid reservoir, and
an atomizer adapted to atomize a liquid stored in the liquid reservoir;
an air duct configured to guide atomized liquid from the atomizer towards the air inhalation port;
a receiving section located at a back end of the atomizer/liquid reservoir portion; and
an additive reservoir removably attachable to the receiving section, the additive reservoir comprising:
an additive storage volume,
a through hole extending through the additive reservoir and being configured to communicate with the air duct to guide atomized liquid to the air inhalation port, and
an additive outlet opening that opens the additive storage volume to the through hole.

2. The electronic smoking device according to claim 1, wherein the additive reservoir is provided between the air inhalation port and the liquid reservoir.

3. The electronic smoking device according to claim 2, wherein the additive outlet opening is arranged at a distance to the atomizer.

4. The electronic smoking device according to claim 2, wherein the liquid reservoir and the additive reservoir are provided adjacent to each other.

5. The electronic smoking device according to claim 1, wherein the additive reservoir is received in the receiving section.

6. The electronic smoking device according to claim 5, wherein the additive reservoir portion comprises a protrusion that projects from the receiving section.

7. The electronic smoking device according to claim 1, wherein the through hole of the additive reservoir has a maximum inner diameter that corresponds to the inner diameter of the air duct.

8. The electronic smoking device according to claim 1, wherein the additive reservoir comprises an additive supply duct that extends from an outer lateral side of the additive reservoir through the additive outlet opening into the through hole.

9. The electronic smoking device according to claim 8, wherein the additive supply duct is formed as a straight duct and completely extends through the additive reservoir.

10. The electronic smoking device according to claim 1, wherein the additive reservoir comprises a wick that extends through the additive outlet opening into the through hole.

11. The electronic smoking device according to claim 10, wherein the wick extends from the through hole in opposite directions into different sections of the additive storage volume.

12. The electronic smoking device according to claim 1, wherein the through hole comprises a constricting section in which a diameter of the through hole decreases, wherein the additive outlet opening opens into the constricting section.

13. The electronic smoking device according to claim 12, wherein in the constricting section, the through hole is formed by a first and a second pair of opposite lateral side sections, wherein the opposite lateral side sections of the first pair are tapered towards each other and the opposite lateral side sections of the second pair are tapered less towards each other than the opposite lateral side sections of the first pair.

14. The electronic smoking device according to claim 13, wherein the additive outlet opening is arranged in one of the lateral side sections of the second pair.

* * * * *